US005779826A

United States Patent [19]

Nayar et al.

[11] Patent Number: 5,779,826

[45] Date of Patent: Jul. 14, 1998

[54] METHOD FOR FORMING HEAT TREATING ATMOSPHERES

[75] Inventors: Harbhajan S. Nayar, Murray Hill; John J. Dwyer, Jr., Edison; Edward Chang, Gillette, all of N.J.

[73] Assignee: The BOC Group, Inc., New Providence, N.J.

[21] Appl. No.: 939,860

[22] Filed: Sep. 29, 1997

Related U.S. Application Data

[63] Continuation of Ser. No. 635,089, Apr. 19, 1996, abandoned.

[51] Int. Cl.[6] ..... C21D 1/76; C21D 1/74

[52] U.S. Cl. ..... 148/633; 148/634; 148/708

[58] Field of Search ..... 148/633, 634, 148/708

[56] References Cited

U.S. PATENT DOCUMENTS

| | | |
|---|---|---|
| 4,386,972 | 6/1983 | Knight . |
| 4,992,113 | 2/1991 | Baldo et al. . |
| 5,045,126 | 9/1991 | Comier et al. . |
| 5,069,728 | 12/1991 | Rancon et al. . |
| 5,192,485 | 3/1993 | Kuramoto et al. . |
| 5,207,839 | 5/1993 | Claverie et al. . |
| 5,221,369 | 6/1993 | Bowe et al. . |
| 5,242,509 | 9/1993 | Rancon et al. . |
| 5,254,180 | 10/1993 | Bonner et al. . |
| 5,259,893 | 11/1993 | Bonner et al. . |
| 5,284,526 | 2/1994 | Garg et al. . |
| 5,290,480 | 3/1994 | Garg et al. . |
| 5,298,089 | 3/1994 | Bowe et al. . |
| 5,298,090 | 3/1994 | Garg et al. . |
| 5,302,213 | 4/1994 | Bonner et al. . |
| 5,308,707 | 5/1994 | Cellier et al. . |
| 5,320,818 | 6/1994 | Garg et al. . |
| 5,322,676 | 6/1994 | Epting . |
| 5,324,366 | 6/1994 | Keil et al. . |
| 5,333,776 | 8/1994 | Garg et al. . |
| 5,342,455 | 8/1994 | Bonner et al. . |
| 5,348,592 | 9/1994 | Garg et al. . |
| 5,417,774 | 5/1995 | Garg et al. . |
| 5,441,581 | 8/1995 | Van den Sype et al. . |

FOREIGN PATENT DOCUMENTS

| | | |
|---|---|---|
| 2114206 | 8/1994 | Canada . |
| 0 598 384 A1 | 5/1994 | European Pat. Off. . |
| 0 603 799 A2 | 6/1994 | European Pat. Off. . |

*Primary Examiner*—Deborah Yee

*Attorney, Agent, or Firm*—R. Hain Swope; Salvatore P. Pace; William A. Schoneman

[57] ABSTRACT

The present invention is directed to a method for forming a heat treating atmosphere in which a nitrogen rich gas containing small amounts of oxygen is preheated. An oxygen-reactive gas, such as a hydrocarbon gas, is combined with the nitrogen rich gas and the mixture is reacted outside of the furnace at temperatures above which substantial sooting does not occur. The resulting heat treating atmosphere is then forwarded to the furnace for conducting the heat treating process.

20 Claims, 2 Drawing Sheets

METHOD FOR FORMING HEAT TREATING ATMOSPHERES

This is a continuation of Ser. No. 08/635,089, filed Apr. 19, 1996 by, Harbhajan S. NAYAR, John J. DWYER, Jr. and Edward CHANG for METHOD FOR FORMING HEAT TREATING ATMOSPHERES, now abandoned.

TECHNICAL FIELD

The present invention is directed to a method and apparatus for heat treating metals in which a heat treating atmosphere is formed outside of the furnace at a preheating temperature at which substantial sooting does not occur. A nitrogen rich gas is preheated and only after reaching a preheating temperature the preheated nitrogen rich gas is combined with an oxygen reactive gas to form the heat treating atmosphere outside of the furnace. Selective heat treating atmospheres can be produced and delivered to a furnace with a preselected, non-decarburizing, reducing, non-oxidizing or inerting capability.

BACKGROUND OF THE PRIOR ART

Heat treating atmospheres based on nitrogen are well known for use in heat treating metals. While such atmospheres were at one time commonly produced through the combination of cryogenically produced nitrogen and hydrocarbons and/or hydrogen, more recently non-cryogenic sources of nitrogen have been employed. Specifically, non-cryogenic air separation techniques such as pressure swing adsorption and membrane separation have enabled the production of nitrogen rich gases containing relatively small amounts of oxygen gas (i.e. typically less than 10% by volume). Non-cryogenically produced nitrogen and hydrocarbons and/or hydrogen have been used wherein oxygen from the nitrogen rich gas reacts with hydrogen or a hydrocarbon to convert the oxygen to water, carbon dioxide and/or carbon monoxide.

The formation of heat treating atmospheres has been performed by mixing the starting gases at room temperature and then injecting the mixture into a furnace typically heated at temperatures exceeding 600° C. and more typically up to 1200° C. In accordance with such processes, the heat treating atmosphere is formed in situ within the furnace at furnace reaction temperatures.

More recently, a heat treating process has been disclosed wherein the non-cryogenically produced nitrogen rich gas is preheated to a temperature of 200°–400° C. and then mixed with a hydrocarbon gas. The resulting mixture is then sent to a catalytic reactor to convert the oxygen from the nitrogen rich gas to a mixture of hydrogen, carbon monoxide, moisture and carbon dioxide. The resulting reactor effluent stream which contains a mixture of nitrogen, moisture, carbon dioxide, hydrogen, carbon monoxide and unreacted hydrocarbon is sent to the furnace as a heat treating atmosphere. Examples of such heat treating processes are disclosed in D. Garg et al., U.S. Pat. No. 5,298,090, U.S. Pat. No. 5,320,818 and U.S. Pat. No. 5,417,774, each of which is incorporated herein by reference.

Each of these patents discloses the preheating of a nitrogen rich gas to a relatively low temperature of from about 200°–400° C. The preheating temperature is minimized because the reaction between oxygen from the nitrogen rich gas and a hydrocarbon gas is exothermic and therefore it is advisable to limit the preheating temperature to below 400° C. to avoid thermal cracking of the hydrocarbon gas and the deposition of soot on the catalyst. It is the catalyst that is relied on to initiate and sustain the reaction between oxygen and the hydrocarbon gas.

Precious metal catalysts are employed for the reaction which are selected from platinum group metals such as platinum, palladium, rhodium, ruthenium, iridium, osmium and mixtures thereof. It is well known that precious metal catalysts are expensive and that catalytic systems employing the same add to the cost of providing the heat treating atmosphere. In addition, such systems are all disadvantageous because continuous reliance on catalysts to initiate and maintain the reaction, results in aging of the catalyst and inefficient reaction dynamics.

Another approach to the formation of a heat treating atmosphere is disclosed in Y. Rancon et al., U.S. Pat. No. 5,242,509. In this process, a precious metal catalyst is heated to a temperature of from 400° C. to 900° C. A mixture of nitrogen rich gas and hydrocarbon gas is then passed into contact with the precious metal catalyst. Thus, the '509 patent heats the catalyst and relies on the heated catalyst to raise the temperature of the nitrogen rich gas and the hydrocarbon gas and to initiate the reaction thereof.

The process disclosed in the '509 patent is disadvantageous because, like the processes disclosed in for example, U.S. Pat. No. 5,298,090, a catalyst, particularly a precious metal catalyst, is essential to initiate and maintain the reaction. In the absence of a precious metal catalyst, each of these processes would result in significant sooting. As previously indicated the cost of precious metal catalysts adds significantly to the cost of heat treating metals.

In addition, heating of the catalyst is less efficient than heating the gases directly. When the catalyst is heated, the gases passing into contact with the catalyst will be heated, but to a lower temperature than the catalyst itself. This is especially apparent in commercial heat treating processes employing very high flow rates. The high flow rate causes cooling of the catalyst which lowers reaction efficiency.

It would therefore be a significant advance in the art of forming heat treating atmospheres if the heat treating atmosphere could be formed outside of the furnace without the significant formation of soot. It would be a further advance in the art to provide a heat treating process which efficiently reacts oxygen present in the nitrogen rich gas without relying on expensive catalysts to initiate and maintain the reaction.

SUMMARY OF THE INVENTION

The present invention is directed to a method of heat treating a metal in which a heat treating atmosphere is formed outside of the furnace in a cost effective and efficient manner. In one aspect of the invention, the method of heat treating a metal comprises:

a) preheating a gas consisting of a nitrogen rich gas to a preheating temperature;

b) adding to the preheated nitrogen rich gas an oxygen-reactive gas to form a reaction mixture at a reaction temperature at which substantial sooting does not occur;

c) reacting the reaction mixture at said reaction temperature to form a heat treating atmosphere in the absence of a catalyst;

d) transferring the heat treating atmosphere to a furnace; and e) heat treating the metal in said furnace in the presence of said heat treating atmosphere.

In another aspect of the invention, the heat treating atmosphere is formed by preheating only the nitrogen rich gas at a preheating temperature above 400° C., most typically above 500° C., preferably in the range of from about 600° to 1200° C., and then combining the preheated nitrogen rich gas with the oxygen-reactive gas to form a reaction mixture which reacts to form the heat treating atmosphere in the optional presence of a catalyst.

The formation of the heat treating atmosphere outside of the furnace is generally accomplished by preheating the nitrogen rich gas only and then combining the same with the oxygen-reactive gas to form a reaction mixture having a temperature above which substantial sooting does not occur. The process is conducted in the absence of a catalyst, although a catalyst may be used to enhance the efficiency of the reaction.

In accordance with the present invention, the heat treating atmosphere is formed in an effective and cost efficient manner and can be tailored to particular heat treating processes which may require a reducing, non-reducing, non-decarburizing or an essentially inerting atmosphere.

BRIEF DESCRIPTION OF THE DRAWINGS

The following drawings are illustrative of embodiments of the invention and are not intended to limit the invention as encompassed by the claims forming part of the application.

DETAILED DESCRIPTION OF THE INVENTION

Figure 1:
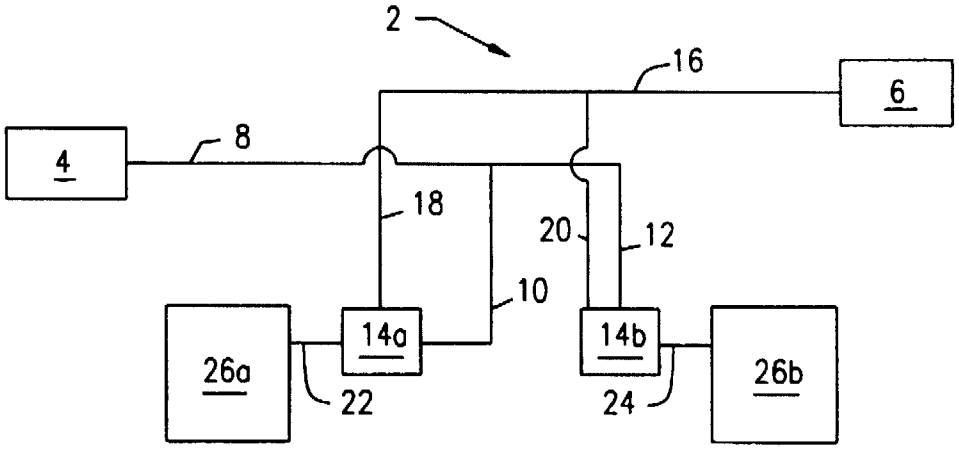
FIG. 1 is a schematic view of an apparatus suitable for forming a heat treating atmosphere in accordance with the present invention.

The present invention is directed to a method of heat treating a metal in which the heat treating atmosphere, which may be a reducing or a non-reducing atmosphere, is formed external to the furnace. A nitrogen rich gas only is preheated. The preheated nitrogen rich gas is then combined with an oxygen-reactive gas to form the heat treating atmosphere at temperatures above which substantial sooting does not occur.

The heat treating atmosphere is then sent to the furnace, preferably in the absence of cooling, where the metal is heat treated at temperatures typically up to about 1200° C. In accordance with the present invention, the preheating step heats the nitrogen rich gas only to temperatures above the temperatures employed in prior art preheating processes which directly heat the nitrogen rich gas and require a catalyst to initiate the reaction. The present invention which requires the preheating of the nitrogen rich gas also distinguishes over prior art which heat the catalyst directly. The preheating of the nitrogen rich gas generally takes place at temperatures above 400° C., typically above 500° C. Preferred preheating temperatures will be at least 600° C., most preferably in the range of from about 600° to 1200° C.

The reactants for forming the heat treating atmosphere are a nitrogen rich gas and an oxygen-reactive gas. The term "nitrogen rich gas" is defined herein as containing no more than about 10% by volume of oxygen gas, preferably no more than about 5% by volume of oxygen gas, and most preferably no more than about 2% by volume of oxygen gas. The nitrogen rich gas can be obtained from any source. The preferred source is air which has been subjected to pressure swing adsorption or membrane separation to remove a substantial portion of the oxygen gas contained therein. Pressure swing adsorption systems and membrane separation systems are well known in the art.

As used herein, the term "oxygen-reactive gas" shall mean any gas capable of reacting with oxygen. Preferred oxygen-reactive gases include hydrogen; hydrocarbons, including lower alkanes (e.g. methane, ethane, propane, butane and mixtures thereof); alcohols such as methanol, ethanol, propanol, butanol and mixtures thereof; liquid petroleum gas (LPG); and the like and mixtures thereof.

The molar ratio of the oxygen gas present in the nitrogen rich gas to the oxygen-reactive gas can be varied within a range to produce heat treating atmospheres which vary from highly reducing to non-reducing. The maximum and minimum values of the ratios of oxygen to oxygen-reactive gas can be calculated from balancing the oxidation reactions. As the molar ratio approaches the minimum value, the reaction of the nitrogen rich gas (i.e. the oxygen gas contained therein) and the oxygen-reactive gas will produce a predominant amount of nitrogen along with carbon monoxide and hydrogen. As the molar ratio increases to the maximum value, the principal products will be nitrogen gas along with carbon dioxide and water vapor which provide a non-reducing atmosphere. For example, the molar ratio of oxygen gas to methane gas is in the range from about 0.5 to 2.0. The molar ratio of oxygen gas to propane is from about 1.5 to 5.0 and the molar ratio of oxygen gas to methanol is from 0.0 to about 1.5. In accordance with the present invention, the nitrogen rich gas and the oxygen-reactive gas can be combined and reacted in specific stoichiometric ratios to produce the desired type of heat treating atmospheres. Thus, relatively low molar ratios of oxygen gas to oxygen-reactive gas will result in the production of higher amounts of reducing species (e.g., carbon monoxide and hydrogen).

An embodiment of the apparatus of the present invention for forming a heat treating atmosphere and delivering the same to a furnace is shown in FIG. 1. Referring to FIG. 1, the heat treating system 2 obtains an oxygen-reactive gas from a source 4 and a nitrogen rich gas from a source 6. As used in the embodiments described herein, a hydrocarbon gas (i.e. methane) will be used as exemplary of an oxygen-reactive gas. It will be understood that oxygen-reactive gases in general are within the spirit and scope of the present invention.

The nitrogen rich gas is preferably obtained from the separation of air through the use of pressure swing adsorption and/or membrane separation systems and generally has an oxygen content of no more than 10% by volume.

The hydrocarbon gas from a source 4 is delivered through a conduit 8 into two divided streams passing through conduits 10 and 12 into heat treating formation chambers **14*a* and 14*b*. It will be understood that in accordance with the present invention the hydrocarbon gas can be delivered to a plurality of heat treating formation chambers. In the embodiment shown in FIG. 1, two such heat treating formation chambers 14*a* and 14*b*** are shown for illustrative purposes only.

Figure 2:
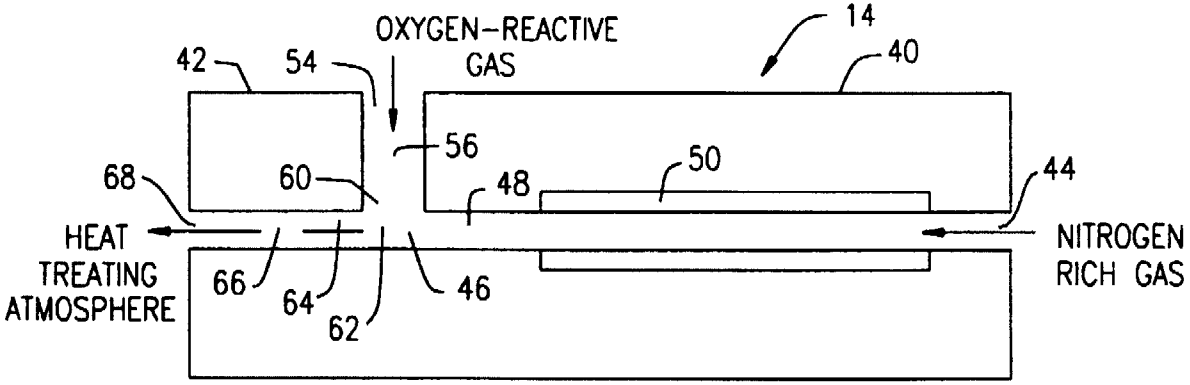
FIG. 2 is a cross-sectional view of a heating chamber employed in the apparatus of FIG. 1.

The chambers **14*a* and 14*b* also receive a nitrogen rich gas from the source 6. The nitrogen rich gas passes through a conduit 16 into two divided streams 18 and 20. The construction of a preheating chamber 14*a* or 14*b* is illustrated in FIG. 2. As shown in FIG. 2, the preheating chamber 14 comprises a preheating section 40 and a reaction section 42. The preheating section 40 has an inlet 44 for the nitrogen rich gas and an opposed outlet 46 connected to the inlet 44 via a conduit 48. Within the conduit 48 is a heating assembly 50 which is preferably annular about the conduit 48**.

The reaction section 42 includes an inlet 54 for the hydrocarbon gas obtained from a source (not shown) through a conduit 56 exiting into outlet 60 which is in an area 62 juxtaposed with the outlet 46 of the conduit 48. In the area 62 the preheated nitrogen rich gas and the oxygen-reactive gas come together where they react to form the heat treating atmosphere.

The heating assembly 50 is sufficient to preheat the nitrogen rich gas to a temperature high enough so that when the nitrogen rich gas is reacted with the hydrocarbon gas substantial sooting does not occur. As used herein, the phrase "substantial sooting does not occur" shall mean no sooting or an amount of sooting which does not adversely affect the formation of the heat treating atmosphere. It will be understood, however, that in a preferred form of the invention little, if any, sooting takes place.

Preheating is generally conducted at temperatures exceeding 400° C., typically at least about 500° C. and preferably from about 600° to 1200° C. The preheated nitrogen rich gas when placed in contact with the hydrocarbon gas in the area 62 results in the formation of the heat treating atmosphere.

It will be understood that a catalyst, particularly a precious metal catalyst, is not required to initiate and/or maintain the reaction between the nitrogen rich gas and the hydrocarbon gas. By preheating the nitrogen rich gas only to preheating temperatures above which sooting does not occur, the use of a catalyst can be avoided. It will be further understood that although clearly not required a catalyst may be used continuously or intermittently to enhance the reaction efficiency, particularly at the latter stages of the reaction.

Referring again to FIG. 2, catalyst 64 may be provided in proximity to the reaction area 62 to improve the rate of reaction between the nitrogen rich gas and the hydrocarbon gas. In the embodiment of FIG. 2 the catalyst is shown just inside a conduit 66 through which the heat treating atmosphere passes to leave the preheating chamber 14 through an outlet 68.

As a consequence, the heat treating formation chambers **14*a* and 14*b* shown in FIG. 1 preheat a nitrogen rich gas containing a predominant amount of nitrogen gas and a minor amount (i.e. up to 10% by volume) of oxygen gas and after preheating allows for the addition of a hydrocarbon gas. When the two gases are reacted together the heat treating atmosphere is thereby formed. The resulting heat treating atmosphere is then forwarded via respective conduits 22 and 24 to furnaces 26*a* and 26*b***, respectively where heat treating of metals takes place in the heat treating atmosphere.

The molar ratio of oxygen to the hydrocarbon gas controls the composition of the heat treating atmosphere and particularly the reducing value of such atmosphere. In accordance with the present invention, minimizing the molar ratio will result in a highly reducing atmosphere containing significant amounts of carbon monoxide and hydrogen gas. For a molar ratio of oxygen to methane of 0.5, twice as much methane must be added to the system than the amount of oxygen present in the nitrogen rich gas. Thus, for a nitrogen rich gas containing 98% by volume of nitrogen and 2% by volume of oxygen, the methane addition of twice the amount of oxygen, reduces the amount of nitrogen to about 94% by volume. The amount of nitrogen gas in the resulting atmosphere will be about 88% by volume, the amount of carbon monoxide will be about 4% by volume and the amount of hydrogen will be about 8% by volume, with small amounts of carbon dioxide and water.

If the same nitrogen rich gas is employed (i.e. 2% by volume of oxygen gas), but the molar ratio of oxygen to methane is 2.0, the resulting heat treating atmosphere will be non-reducing and contain about 97% by volume of nitrogen, 1% by volume of carbon dioxide and 2% by volume of water.

The molar ratio of oxygen to hydrocarbon gas can be adjusted according to need depending on whether a reducing or non-reducing atmosphere is desired. For example, by decreasing the concentration of the hydrocarbon gas, more of the residual oxygen is converted into carbon dioxide and water vapor which provides a relatively weak reducing to non-reducing atmosphere. By increasing the concentration of the hydrocarbon gas, the resulting atmosphere is relatively highly reducing since more of the oxygen is converted to carbon monoxide. The increased concentration of hydrocarbon gas also increases the amount of hydrogen formed.

The nitrogen rich gas is sent to the heat treating atmosphere formation chambers **14*a* and 14*b* as shown in FIG. 1**. The nitrogen rich gas is preheated, prior to the addition of the hydrocarbon gas, to temperatures which will allow for the reaction of the hydrocarbon gas with the oxygen present in the nitrogen rich gas. Thus, unlike prior art systems, the nitrogen rich gas alone is preheated to a temperature sufficient so that a substantially soot free reaction takes place between oxygen and the hydrocarbon gas to convert the same to hydrogen, carbon monoxide, carbon dioxide and water vapor in varying amounts. The precise amount of each constituent is determined by the concentration of the hydrocarbon gas and the amount of oxygen gas present in the nitrogen rich gas. The desired preheating temperature as defined herein is generally above 400° C., typically at least about 500° C. and more preferably in the range of from about 600° to 1200° C. The preheating temperature that is selected will depend upon the molar ratio of oxygen to the hydrocarbon gas, the desired degree of completion of the reaction, and the catalyst type (if any) as explained hereinafter.

Figure 3:
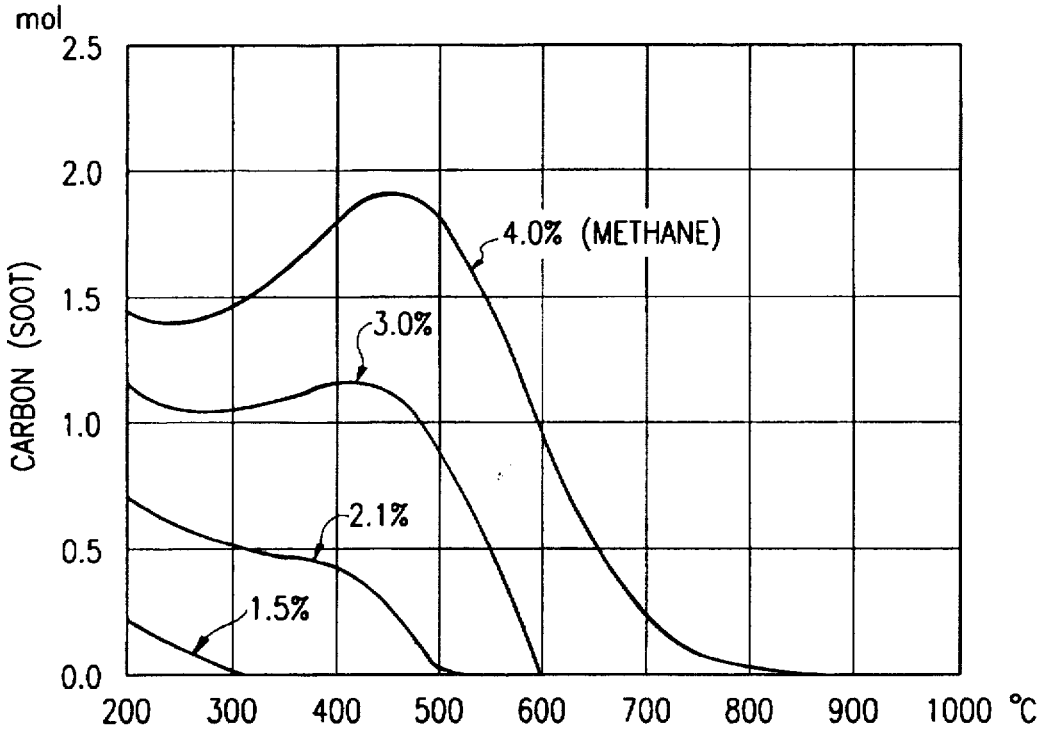
FIG. 3 is a graph showing the amount of carbon (soot) generated during the formation of a heat treating atmosphere with various percentages of methane and a nitrogen rich gas containing 2% by volume of oxygen.
Figure 4:
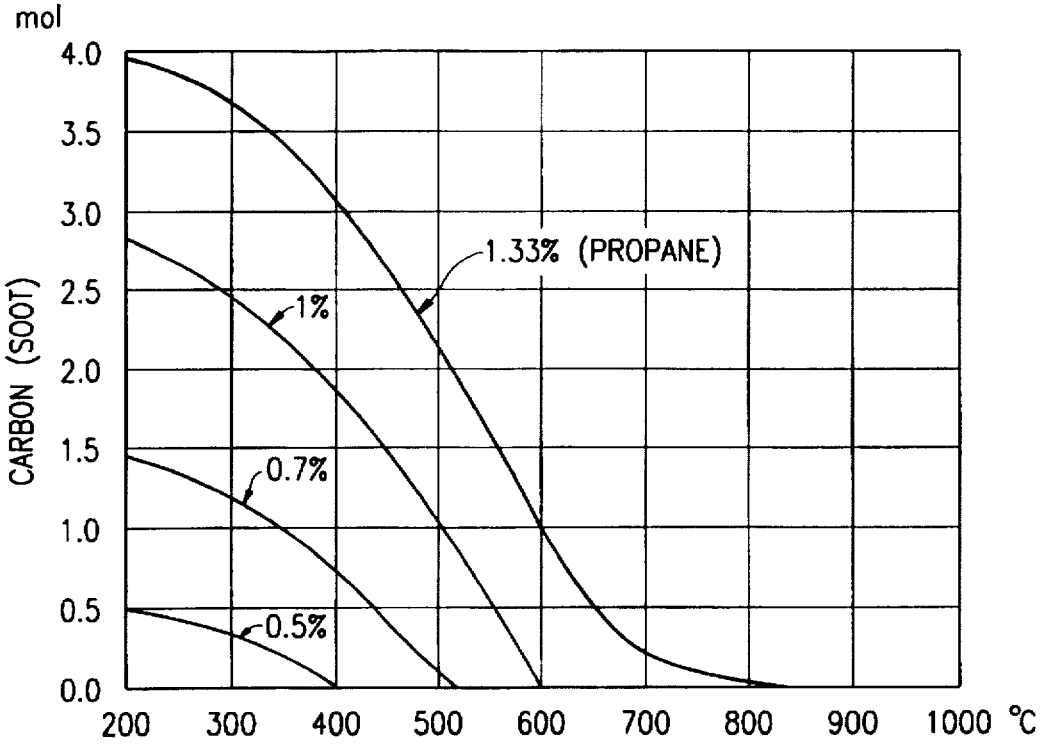
FIG. 4 is a graph showing the amount of carbon (soot) generated during the formation of a heat treating atmosphere using various percentages of propane and a nitrogen rich gas containing 2% by volume of oxygen.

The effect of the molar ratio of oxygen to the hydrocarbon gas based on thermodynamic calculations is shown in FIGS. 3 and 4. Referring to FIG. 3, there is shown four gas mixtures each containing a nitrogen rich gas having 2% by volume oxygen and varying concentrations of methane gas from 1.5% by volume to 4.0% by volume. As shown in FIG. 3, the gas mixture containing 2.1% by volume of methane has a molar ratio of oxygen to methane of about 1.0. In this example, sooting is essentially zero when the preheating temperature is above approximately 550° C. Thus, in accordance with this particular embodiment of the invention, preheating can be conducted at a temperature of at least 500° C. in the absence of a catalyst, without substantial sooting and preferably above 600° C. It will be understood that a catalyst may optionally be used if desired to improve the reaction rate.

When the concentration of methane is increased to 3.0% and thus the molar ratio of oxygen to methane is about 0.67, sooting is substantially zero when the preheating temperature is above about 600° C. As further shown in FIG. 3, when the methane concentration is increased to 4.0% by volume (and the molar ratio is thereby reduced to 0.5), sooting is substantially eliminated when the preheating temperature is above approximately 850° C.

Similar results for the combination of a nitrogen rich gas and propane gas are shown in FIG. 4. Referring to FIG. 4, there is shown four gas mixtures each containing a nitrogen rich gas having 2% by volume oxygen and varying concentrations of propane gas ranging from 0.5% to 1.33%, which are calculated according to the maximum and minimum ratios earlier mentioned. When the gas mixture contains 0.5% by volume of propane, (i.e. a 4.0 molar ratio of oxygen to propane) sooting is essentially zero at a preheating temperature as low as about 400° C. When the concentration of propane is increased to 1% and thus the molar ratio of oxygen to propane is 2.0, sooting is substantially eliminated at a preheating temperature above about 600° C. When the propane concentration is increased to 1.33% by volume, and the molar ratio is thereby reduced to 1.5, sooting is substantially eliminated at a preheating temperature above about 850° C.

As previously discussed, the formation of the heat treating atmosphere can be assisted by the use of an optional catalyst which catalyzes the reaction of the hydrocarbon gas and the oxygen contained in the nitrogen rich gas. Such catalysts are well known in the art and are selected from noble metal catalysts including the platinum metal group catalysts such as platinum, rhodium, palladium and the like. Because the present invention relies on preheating the nitrogen rich gas only to initiate suitable reaction conditions, base metal catalysts such as nickel, cobalt and the like can be used in place of the more expensive platinum group catalysts.

EXAMPLE 1

A heat treating assembly of the type shown in FIG. 2 containing a preheating section and a reaction section within the same housing is employed herein to produce a series of heat treating atmospheres in accordance with the present invention.

200 cubic feet per hour of a nitrogen rich gas containing 99% by volume of nitrogen and 1% by volume of oxygen is fed to the preheating chamber. The nitrogen rich gas only is heated to an average temperature of 1096° C. The preheated nitrogen rich gas is then combined in the absence of a catalyst with an amount of methane gas sufficient to provide a molar ratio of oxygen to methane of 1:1. The methane and the oxygen contained in the nitrogen rich gas immediately react to produce reaction products as shown in Table 1.

TABLE 1

| EXAMPLE | AVG. PREHEAT TEMP. | $H_2$ %* | $H_2O$ DEG F. | CO %* | $CO_2$ %* | $CH_4$ %* | $O_2$ PPM |
|---|---|---|---|---|---|---|---|
| 1 | 1096° C. | 1.40 | 35 | 0.67 | 0.26 | 0.22 | 20 |
| 2 | 1052° C. | 1.20 | 34 | 0.55 | 0.30 | 0.36 | 50 |
| 3 | 1011° C. | 1.00 | 33 | 0.43 | 0.30 | 0.55 | 88 |
| 4 | 953° C. | 0.85 | 33 | 0.20 | 0.36 | 0.66 | 186 |
| 5 | 920° C. | 0.55 | 35 | 0.15 | 0.38 | 0.88 | 191 |
| 6 | 857° C. | 0.45 | 36 | 0.10 | 0.42 | 0.90 | 264 |
| 7 | 810° C. | 0.45 | 36 | 0.05 | 0.42 | 0.88 | 537 |

%* = % by volume

EXAMPLES 2–7

The process of Example 1 is repeated for Examples 2–7 except that the temperature is changed as indicated in Table 1. The amount of each of the reaction products is determined and the results are shown in Table 1.

As shown in Table 1, the process of the present invention provides a method of obtaining a heat treating atmosphere by operating at a preheating temperature at which substantial sooting does not occur. Furthermore, the amount of hydrogen and carbon monoxide decrease with decreasing temperature while the amount of moisture, methane and oxygen increase with decreasing temperature.

EXAMPLES 8–14

The process of Examples 1–7 is repeated except the nitrogen rich stream contains 3% by volume and the amount of methane gas is sufficient to provide a molar ratio of oxygen to methane of 1:1. Examples 8–14 are run at slightly different temperatures than Examples 1–7. The results are shown in Table 2.

TABLE 2

| EXAMPLE | AVG. PREHEAT TEMP. | $H_2$ %* | $H_2O$ DEG F. | CO %* | $CO_2$ %* | $CH_4$ %* | $O_2$ PPM |
|---|---|---|---|---|---|---|---|
| 8 | 1109° C. | 3.25 | 38 | 2.05 | 0.72 | 0.36 | 30 |
| 9 | 1057° C. | 2.74 | 42 | 1.85 | 0.80 | 0.45 | 40 |
| 10 | 1029° C. | 2.59 | 39 | 1.45 | 0.89 | 0.92 | 91 |
| 11 | 952° C. | 1.02 | 41 | 0.55 | 1.15 | 1.55 | 91 |
| 12 | 904° C. | 0.61 | 40 | 0.25 | 1.20 | 1.66 | 340 |
| 13 | 859° C. | 0.54 | 42 | 0.20 | 1.28 | 1.64 | 1303 |
| 14 | 804° C. | 0.50 | 41 | 0.10 | 1.24 | 1.72 | 1500 |

%* = % by volume

As shown in Examples 8–14, the process of the present invention provides a method of obtaining a heat treating atmosphere by operating at a preheating temperature at which substantial sooting does not occur. Furthermore, the amount of hydrogen and carbon monoxide decrease with decreasing temperature while the amount of moisture, methane and oxygen increase with decreasing temperature. It should also be noted that the amounts of each of the components is greater than for Examples 1–7. This is because of the higher starting concentration of oxygen and methane.

EXAMPLE 15

The same procedure as employed in Example 1 is used except that this example is conducted at a temperature of about 1098° C. and the molar ratio of oxygen to methane is 2:1. The results are shown in Table 3.

TABLE 3

| EXAMPLE | MOLAR RATIO $O_2$:METHANE | AVG. PREHEAT TEMP. | $H_2$ %* | $H_2O$ DEG F. | CO %* | $CO_2$ %* | $CH_4$ %* | $O_2$ PPM |
|---|---|---|---|---|---|---|---|---|
| 15 | 2:1 | 1098° C. | 0.30 | 40 | 0.12 | 0.38 | 0.00 | 45 |
| 16 | 4:3 | 1098° C. | 0.60 | 45 | 0.33 | 0.36 | 0.04 | 40 |
| 17 | 1:1 | 1098° C. | 1.15 | 41 | 0.63 | 0.28 | 0.20 | 42 |
| 18 | 0.8:1 | 1098° C. | 1.60 | 37 | 0.80 | 0.24 | 0.36 | 65 |
| 19 | 0.67:1 | 1098° C. | 1.80 | 38 | 0.90 | 0.24 | 0.40 | 67 |

%* = % by volume

EXAMPLES 16–19

The same procedure as employed in Example 15 is repeated except that the molar ratio of oxygen to methane is varied as shown in Table 3.

As shown in Table 3, varying the molar ratio of oxygen to methane enables the production of heat treating atmospheres having variable compositions and properties. At a constant temperature, as the molar ratio of oxygen to methane decreases, the amount of hydrogen, carbon monoxide and unreacted methane increases. Conversely, with a decreasing oxygen to methane molar ratio, the amount of moisture and carbon dioxide decreases.

At relatively high preheating temperatures (e.g. 1098° C.) all or substantially all of the methane reacts in the absence of a catalyst, especially at relatively high oxygen to methane ratios.

EXAMPLES 20–23

The procedure of Example 15 is repeated except that the nitrogen rich gas contains 2% by volume of oxygen gas. The molar ratio of oxygen to methane is varied as shown in Table 4.

TABLE 4

| EXAMPLE | MOLAR RATIO $O_2$:METHANE | AVG. PREHEAT TEMP. | $H_2$ %* | $H_2O$ DEG F. | CO %* | $CO_2$ %* | $CH_4$ %* | $O_2$ PPM |
|---|---|---|---|---|---|---|---|---|
| 20 | 2:1 | 1102° C. | 1.18 | 54 | 0.55 | 0.74 | 0.00 | 181 |
| 21 | 1:3:1 | 1102° C. | 1.50 | 56 | 0.80 | 0.71 | 0.00 | 95 |
| 22 | 1:1 | 1102° C. | 1.80 | 57 | 1.00 | 0.68 | 0.20 | 61 |
| 23 | 0.8:1 | 1102° C. | 2.30 | 56 | 1.35 | 0.60 | 0.38 | 47 |

%* = % by volume

As shown in Table 4, varying the molar ratio of oxygen to methane enables the production of heat treating atmospheres having variable compositions and properties. At a constant temperature, as the molar ratio of oxygen to methane decreases, the amount of hydrogen, carbon monoxide and unreacted methane increases. Conversely, with a decreasing oxygen to methane molar ratio, the amount of moisture and carbon dioxide decreases. The amount of the components of the heat treating atmosphere shown in Examples 20–23 exceed the amounts shown in Examples 15–19 because of the higher starting amounts of oxygen and methane.

At relatively high preheating temperatures (e.g. 1098° C.) all or substantially all of the methane reacts in the absence of a catalyst, especially at relatively high oxygen to methane ratios.

EXAMPLES 24–25

The procedure of Example 1 is repeated except that for Example 24 the preheating temperature is 857° C. and a commercially available catalyst comprised of platinum and rhodium on an alumina support is employed to assist the reaction of the oxygen from the nitrogen rich gas and methane. Example 25 is conducted in the same manner in the absence of a catalyst. The results are shown in Table 5.

TABLE 5

| EXAMPLE | CATALYST | UNREACTED METHANE (VOL %) |
|---|---|---|
| 24 | YES | 0 |
| 25 | NO | .64 |

As shown in Table 5, Example 24 conducted in the presence of a catalyst showed somewhat better conversion of methane to produce the heat treating atmosphere.

EXAMPLES 26–28

A heat treating assembly of the type described in Example 1 is used to produce heat treating atmospheres in accordance with the following.

100 cubic feet per hour of a nitrogen rich gas containing 99.5% by volume of nitrogen and 0.5% by volume of oxygen is fed to the preheating chamber. The nitrogen rich gas only is preheated to a temperature of 720° C. The preheated nitrogen rich gas is then combined in the absence of a catalyst with propane gas in the amounts shown in Table 6. The propane and the oxygen contained in the nitrogen rich gas immediately react to produce reaction products as shown in Table 6.

TABLE 6

| EXAMPLE | 26 | 27 | 28 |
|---|---|---|---|
| MOLAR RATIO - $O_2$: PROPANE | 5:1 | 2.5:1 | 1.67:1 |
| AVG. PREHEAT TEMPERATURE | 720° C. | 720° C. | 720° C. |
| $H_2$ % * | 0.20 | 0.40 | 0.50 |
| $H_2O$ DEG F. | 29.0 | 10.5 | 10.5 |
| CO % * | 0.272 | 0.223 | 0.253 |
| $CO_2$ % * | 0.410 | 0.278 | 0.275 |
| $C_4$ % * | 0.106 | 0.264 | 0.318 |
| $O_2$ PPM | 112 | 24.7 | 24.5 |

% * = % by volume

As shown in Table 6, the process of the present invention provides a method of obtaining a heat treating atmosphere by operating at a preheating temperature at which substantial sooting does not occur.

What we claim is:

1. A method of heat treating a metal comprising:

a) preheating a gas consisting of a nitrogen rich gas to a preheating temperature;

b) adding to the preheated nitrogen rich gas an oxygen-reactive gas to form a reaction mixture at a reaction temperature at which substantial sooting does not occur;

c) reacting the reaction mixture at said reaction temperature to form a heat treating atmosphere in the absence of a catalyst;

d) transferring the heat treating atmosphere to a furnace; and e) heat treating the metal in said furnace in the presence of said heat treating atmosphere.

2. The method of claim 1 comprising preheating the nitrogen rich gas to a temperature of more than at least about 400° C.

3. The method of claim 1 comprising preheating the nitrogen rich gas to a temperature of at least about 500° C.

4. The method of claim 1 wherein the preheating temperature is from about 600° to 1200° C.

5. The method of claim 1 wherein the oxygen-reactive gas is selected from the group consisting of hydrogen, hydrocarbons, alcohols, liquid petroleum gas and mixtures thereof.

6. The method of claim 5 wherein the hydrocarbon gas is selected from the group consisting of straight or branched chain lower alkanes.

7. The method of claim 6 wherein the lower alkane is methane.

8. The method of claim 1 wherein the nitrogen rich gas contains no more than about 10% oxygen.

9. The method of claim 1 wherein said nitrogen rich gas contains no more than about 5% oxygen.

10. The method of claim 1 wherein said nitrogen rich gas contains no more than about 3% oxygen.

11. The method of claim 1 comprising transferring the heat treating atmosphere to the furnace in the absence of cooling.

12. A method of heat treating a metal comprising:

a) preheating a gas consisting of a nitrogen rich gas to a preheating temperature of above 400° C.;

b) adding to the preheated nitrogen rich gas an oxygen-reactive gas to form a reaction mixture at a reaction temperature;

c) reacting the reaction mixture at said reaction temperature to form a heat treating atmosphere;

d) transferring the heat treating atmosphere to a furnace; and e) heat treating the metal in said furnace in the presence of the heat treating atmosphere.

13. The method of claim 12 further comprising reacting the reaction mixture in the presence of a catalyst.

14. The method of claim 13 wherein the catalysts are selected from the group consisting of noble metal catalysts and base metal catalysts.

15. The method of claim 12 wherein the preheating temperature is at least 500° C.

16. The method of claim 12 wherein the preheating temperature is from about 600° to 1200° C.

17. The method of claim 13 wherein the nitrogen rich gas contains no more than 10% by volume of oxygen.

18. The method of claim 12 wherein the oxygen-reactive gas is selected from the group consisting of hydrogen, hydrocarbon, alcohols, liquid petroleum gas and mixtures thereof.

19. The method of claim 18 wherein the hydrocarbon gas is selected from the group consisting of straight or branched chain lower alkanes.

20. The method of claim 12 comprising transferring the heat treating atmosphere to the furnace in the absence of cooling.

* * * * *

UNITED STATES PATENT AND TRADEMARK OFFICE

CERTIFICATE OF CORRECTION

PATENT NO. : 5,779,826

DATED : July 14, 1998

INVENTOR(S) : Harbhajan Nayer, et al.

It is certified that error appears in the above-identified patent and that said Letters Patent is hereby corrected as shown below:

Add the following new claims.

21. A method of heat treating a metal comprising:

a ) preheating a has consisting of a nitrogen rich gas to a preheating temperature;

b ) adding to the preheated nitrogen rich gas an oxygen-reactive gas in the absence of heating to form a reaction mixture at a reaction temperature at which substantial sooting does not occur;

c ) reacting the reaction mixture at said reaction temperature to form a heat treating atmosphere in the absence of a catalyst;

d ) transferring the heat treating atmosphere to a furnace; and e ) heat treating the metal in the absence of heating in said furnace in the presence of said heat treating atmosphere.

22. A method of heat treating a metal comprising:

a ) preheating a has consisting of a nitrogen rich gas to a preheating temperature of above 400° C . ;

b ) adding to the preheated nitrogen rich gas an oxygen-reactive gas in the absence of heating to form a reaction mixture at a reaction temperature;

c ) reacting the reaction mixture at said reaction temperature to form a heat treating atmosphere;

UNITED STATES PATENT AND TRADEMARK OFFICE

CERTIFICATE OF CORRECTION

PATENT NO. : 5,779,826

DATED : July 14, 1998

INVENTOR(S) : Harbhajan Nayer, et al.

It is certified that error appears in the above-identified patent and that said Letters Patent is hereby corrected as shown below:

d) transferring the heat treating atmosphere to a furnace; and e) heat treating the metal in the absence of heating in said furnace presence of the heat treating atmosphere.

Signed and Sealed this

Twenty-fifth Day of May, 1999

*Attest:*

Q. TODD DICKINSON

*Attesting Officer*

*Acting Commissioner of Patents and Trademarks*